United States Patent [19]

Pail

[11] Patent Number: 4,857,028

[45] Date of Patent: Aug. 15, 1989

[54] PORTABLE PUPPET THEATER KIT

[76] Inventor: Ofer Pail, 960 6th Ave., Suite 1010, New York, N.Y. 10001

[21] Appl. No.: 65,769

[22] Filed: Jun. 23, 1987

[51] Int. Cl.[4] ..... A63H 33/42

[52] U.S. Cl. ..... 446/82; 446/75

[58] Field of Search ..... 446/76, 82, 83, 84, 446/75; 206/44 R; 248/449, 163.2

[56] References Cited

U.S. PATENT DOCUMENTS

| | | | |
|---|---|---|---|
| 939,721 | 11/1909 | Lewis | 206/44 R |
| 1,311,586 | 7/1919 | Beecher | 206/44 R |
| 1,800,948 | 4/1931 | McHugh | 446/82 |
| 1,874,819 | 8/1932 | Simmons | 446/84 |
| 2,104,628 | 1/1938 | Warren | 446/75 |
| 2,705,386 | 4/1955 | Bertram | 446/82 |
| 2,718,091 | 9/1955 | Schrock | 446/84 |
| 2,834,150 | 5/1958 | White | 446/82 |
| 2,837,863 | 6/1958 | Dovall | 446/73 |
| 3,418,746 | 12/1968 | Kharasch | 416/27 |
| 3,563,538 | 2/1971 | Harper | 272/1 R |
| 3,614,840 | 10/1971 | Vadell | 428/13 |
| 3,762,788 | 10/1973 | Heller | 312/240 |
| 3,839,816 | 10/1974 | Fischereder | 446/82 |
| 3,899,168 | 8/1975 | Besherse | 272/21 |
| 3,961,426 | 6/1976 | Wallace | 434/73 |

FOREIGN PATENT DOCUMENTS

| | | | |
|---|---|---|---|
| 334453 | 5/1920 | Fed. Rep. of Germany | 446/75 |
| 2010102A | 6/1979 | United Kingdom | 446/750 X |

*Primary Examiner*—Robert A. Hafer
*Assistant Examiner*—Sam Rimell
*Attorney, Agent, or Firm*—Bryan, Cave, McPheeters & McRoberts

[57] ABSTRACT

A puppet theater kit is provided for use with hand or glove puppets which is easily convertible from a compact portable carrying case wherein all stage structural components, props, curtains, puppets and accessories may be conveniently stored to a puppet theater for puppeteers of various heights and ages. The puppet theater may be supported on the ground or floor by a suitable support means or may be used on tabletop or the like.

14 Claims, 5 Drawing Sheets

PORTABLE PUPPET THEATER KIT

TECHNICAL FIELD

This invention relates to a portable stage for puppet theaters, and in particular to a stage for hand puppet (glove puppet) theaters. Specifically, this invention comprises a portable puppet theater kit used with hand or glove puppets, easily convertible from a compact, portable carrying case wherein all stage structural components, stage props, curtains, puppets and accessories may be conveniently stored, into the theater.

BACKGROUND OF THE INVENTION

Stages used for giving puppet shows with hand or glove puppets typically comprise a single front wall with a fixed stage section and two side walls. The stage section may comprise a lower stage, an upper stage, (see, for example, Fischereder U.S. Pat. No. 3,839,816) and two side walls. The stage usually has an appropriate curtain system for opening and closing the viewing area of the stage and for concealing the puppeteers from the audience. This type of stage has the disadvantage of being permanent in nature, relatively complex to assemble, difficult to store and not easily movable from one place to another.

Collapsible stages used for giving puppet shows with hand or glove puppets are known in the art. Duvall, U.S. Pat. No. 2,837,863 granted June 10, 1958 discloses a folding cardboard stage which is placed into a sheath for carrying purposes. These structures provide inadequate structural strength, are not adjustable in height to accomodate puppeteers of various ages, and lack a front curtain set for opening and closing the viewing area of the theater. Besherse, U.S. Pat. No. 3,899,168 granted Aug. 12, 1975, discloses an umbrella shaped puppet stage, comprising a collapsible umbrella roof and a central upright support. Structures of this type are difficult to store, and are not easily movable from one place to another. In addition, a separate carrying case is required to carry the puppets, stage props, and structural stage components.

Portable display stages used for displaying puppets other than hand or glove puppets are available in several designs. Harper, U.S. Pat. No. 3,563,538 discloses a puppet stage comprising a platform having an aperture and a multiplicity of support members hingedly joined to the platform.

Schrock, U.S. Pat. No. 2,718,091 discloses a toy theater for puppets comprising a foldable scored cardboard body which may be turned upside down for marionettes.

Other puppet theaters known include those for finger puppets (Kharasch U.S. Pat. No. 3,418,764), and stick puppets. (Heller U.S. Pat. No. 3,762,788). These structures lack an appropriate curtain system for opening and closing the viewing area of the theater, are not adjustable in height to accomodate puppeteers of various ages, and do not provide an appropriate structure for operating hand or glove puppets.

SUMMARY OF THE INVENTION

This invention provides a portable puppet theater kit for giving puppet shows using hand activated puppets, easily convertible from a compact carrying case configuration used for storage, shipment or handling. The case may contain all structural elements, curtains, scenery, decorations, puppets and the like, that are usually an integral part of any puppet show.

The portable puppet theater kit of the invention comprises a base for a carrying case convertible into a first stage of the puppet theater; a lid for the carrying case convertible into a second stage of the puppet theater; support means removably received in the carrying case for supporting the stages in fixed, spaced relation relative to each other; and a front curtain set removably received in the carrying case and being convertible into a curtain supported by one of the stages and at least partially shielding the space between the stages from view during operation of the puppet theater. One of the stages is a main stage and the other stage is an auxiliary stage of the puppet theater. When in kit form, the stages are secured to each other and locked therewith providing a compact portable carrying case wherein all other components of the theater are conveniently stored. When assembled into the puppet theater, one of the stages (the main stage) may be mounted on a suitable support, and secured in spaced relation to the other (the auxiliary) stage by the support.

There is thus provided a portable puppet theater kit, easily assembled from its carrying case configuration, conveniently and comfortably operated by puppeteers of various ages and various skills, and strong and durable permitting easy and long lasting use.

The invention further provides a portable puppet theater adaptable for operation on a tabletop or self-supported on the floor or ground, as necessitated by the particular environment in which it is used. The portable puppet theater adjusts in height above the floor to accomodate puppeteers of various ages.

Alternatively, the puppet theater kit may also include a collapsible stand which elevates and supports the assembled theater. The stand may comprise one central stand, adjustable in height to accomodate puppeteers of various ages. The central stand may be mountable on a standard foldable multi-leg base or on a single pedestal, and may in turn support the main stage. Such a central stand facilitates any desired degree of rotation of the assembled puppet theater. The collapsible stand for supporting the theater may instead comprise a plurality of rigid legs, preferably four, mounted in mounting openings in the bottom corners of the main stage thereby providing firm support for the assembled theater.

In the preferred embodiments described hereinafter, the assembled puppet theater also comprises a number of curtains supported from one of the stages and movably attached thereto, including a front curtain set, a side curtain set and a backdrop curtain. The front curtain set comprises two split curtains, mounted on a plurality of rings, and slidable along a curtain rod, for opening and closing the viewing area of the theater. The side curtain set comprises two side curtains. The backdrop curtain may comprise scenery background suitable for the particular show, and may also conceal the puppeteer from the audience. The puppet theater kit may further comprise a lower curtain for concealing the collapsible stand and the puppeteers from the audience. The lower curtain may be removably secured to the outer side of the main stage from which it depends.

In the assembled theater, the auxiliary stage is vertically connected to the main stage by a set of support means, preferably a plurality of vertical rods mounted in a matching number of mounting openings in the main stage. The supports, which may be collapsible if desired, are easily and quickly assembled and disassembled as required.

The main stage may also contain an access door located at its rear (the puppeteer's side) which either folds inward or slides outward when the puppet theater is in operation and is otherwise locked in its closed position. The access door provides easy access to the main stage for the puppeteer.

In accordance with yet a further feature, the main stage may comprise a scenery base, e.g., a board having an arrangement of apertures formed therein. The apertures may receive and support stage props, decorations, scenery and the like as required. The props, decorations, etc. may be mounted to the scenery base in any convenient manner, e.g., by dependent pegs received in the apertures in the base.

BRIEF DESCRIPTION OF THE DRAWINGS

The preceding and other features of the portable puppet theater kit of the invention will be more fully apparent from consideration of the following detailed description of preferred embodiments thereof, taken in connection with the accompanying drawings, in which.

DETAILED DESCRIPTION OF THE PREFERRED EMBODIMENTS

Figure 1:
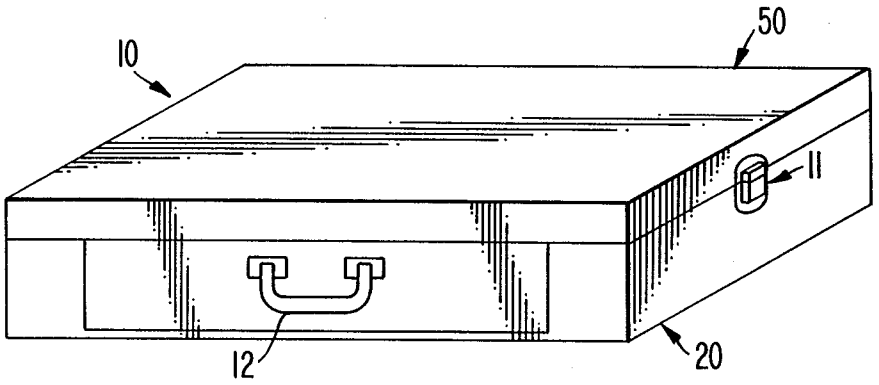
FIG. 1 is a perspective view of the portable theater kit, in its portable carrying case configuration.

As shown in FIG. 1, prior to assembly the portable puppet theater kit takes the form of a carrying case 10, comprising a lid or auxiliary stage 50 mounted on and locked to a base or main stage 20. Two side catches 11 (only one of which is shown in FIG. 1) releasably lock the lid 50 to the base 20. A carrying handle 12 is additionally secured to the base 20 for ease of transportability.

Figure 2:
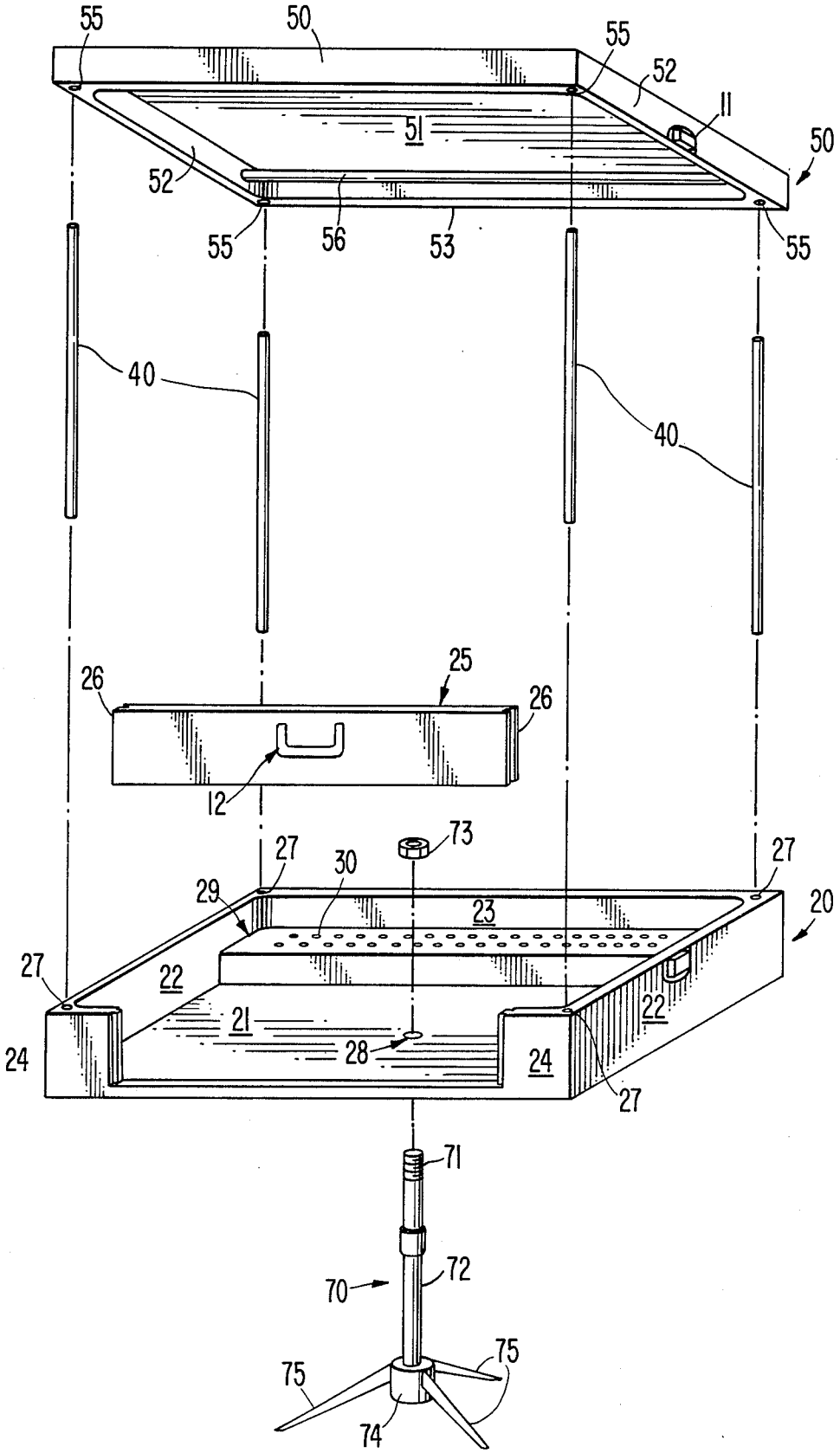
FIG. 2 is an exploded view of the assembled portable puppet theater, showing its various structural elements positioned relative to one another.
Figure 3:
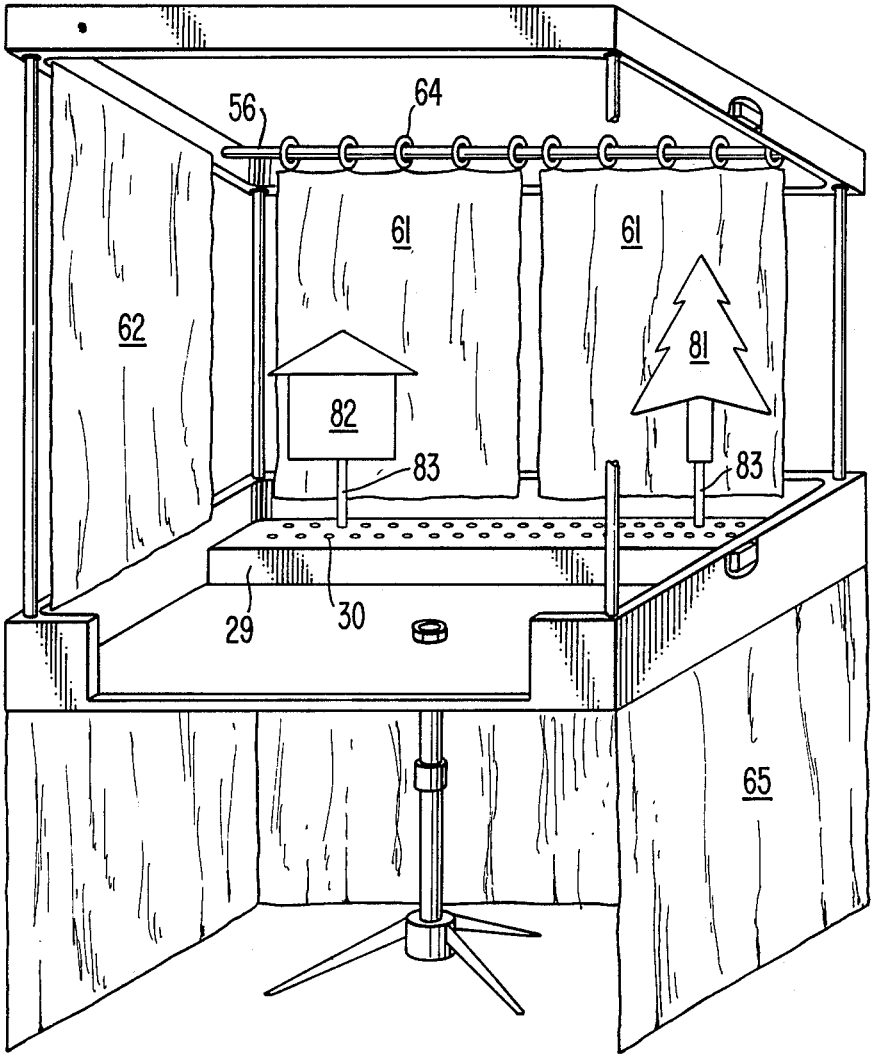
FIG. 3 is a rear perspective view of the assembled portable puppet theater; for purposes of illustration, various curtains and the access door are not shown.
Figure 4:
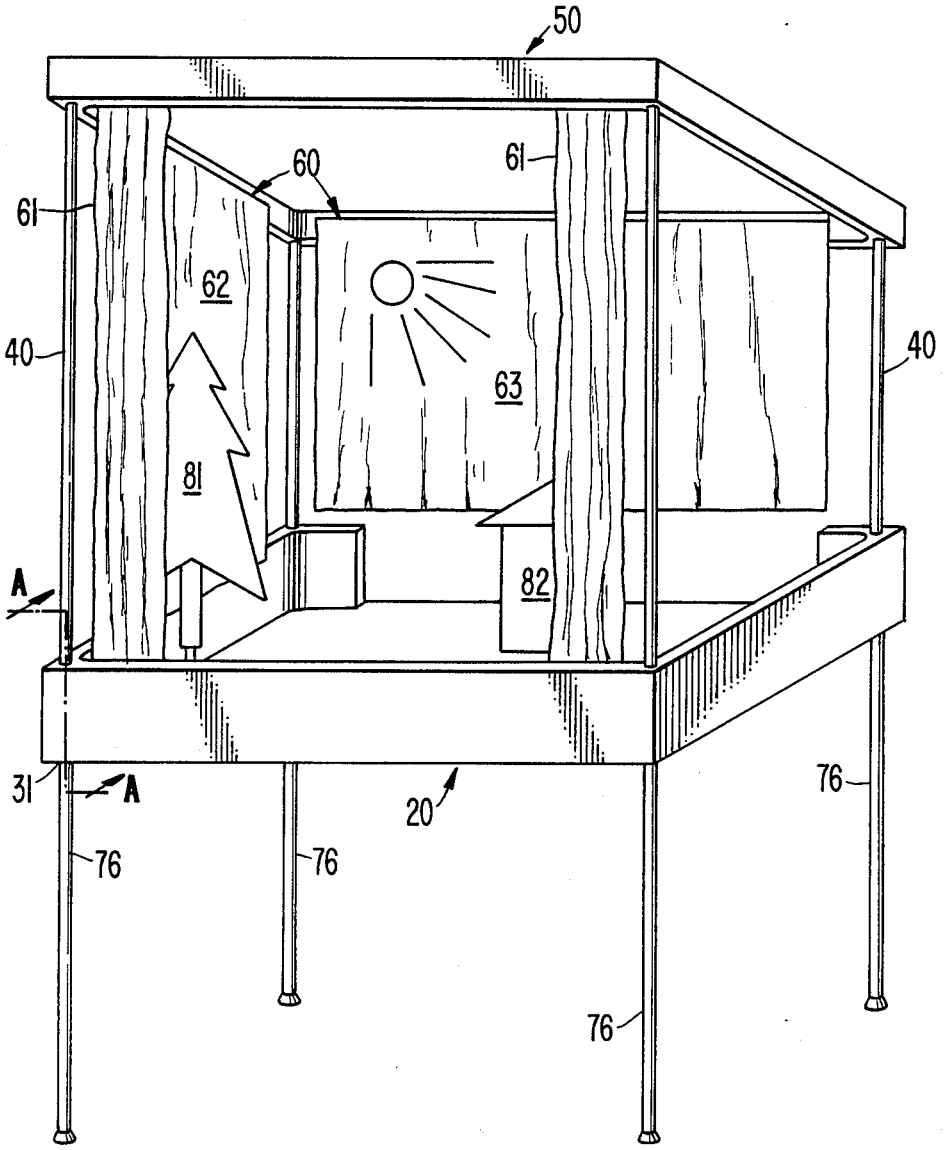
FIG. 4 is a front perspective view of the assembled portable puppet theater, incorporating an alternative embodiment of the support assembly for the theater; again, for purposes of illustration, a side curtain is not shown.

As illustrated in FIGS. 2–4, the assembled portable theater comprises the main stage (the base) 20; the auxiliary stage (the lid) 50; means for supporting the main stage and the auxiliary stage in spaced, fixed relation, viz. rods 40; a number of curtains 60 for concealing the puppeteers from view; and a collapsible theater support 70.

The main stage comprises a base 21 having rigid perpendicular side walls 22, front wall 23 and rear wall or wall members 24.

The main stage further comprises an access door 25 which upon opening provides easy access to the main stage from the rear. The access door comprises a rectangular shaped panel having channeled side members 26 attached thereto for sliding onto and affixing to the rear wall members. The handle 12 is attached to the access door for transporting the puppet theater kit in its portable carrying case.

An access door comprising a folding panel hinged to the base of the main stage may alternatively be provided. When in an upright position, the access door locks to the rear wall members 24 of the main stage 20 by standard locking means, and folds inwardly toward the base 21 of the main stage during use of the theater.

The main stage further comprises four separate mounting openings 27 on the four corners of the main stage, in which the support means 40 are received.

The main stage further comprises a mounting opening 28 located at the center of the base 21 for receiving and supporting the collapsible theater support means 70.

Additionally, the main stage incorporates a scenery base 29 (which may be removable, if desired) comprising a board having a number of apertures 30 for supporting decorations 81, 82, scenery and the like. The decorations and scenery may be received into the apertures of the base by dependent pegs 83.

The auxiliary stage 50 comprises a base 51 having rigid side walls 52, front wall 53 and rear wall 54 extending perpendicular to the base 51.

The auxiliary stage further comprises four mounting openings 55 located at the respective corners of the base 51 of the auxiliary stage for receiving the support means 40 therein. Additionally, the auxiliary stage includes a horizontal curtain rod 56 stretching inside the auxiliary stage from one side wall to the other. Means are provided for supporting the curtain rod to side walls 52.

The portable puppet theater further comprises rods 40 for supporting the auxiliary stage 50 on the main stage 20. The lower ends of rods 40 are received in the mounting openings 27 of the main stage 20 and the upper ends are received in a matching number of mounting openings 55 on the auxiliary stage.

The preferred embodiment of the portable puppet theater further includes a number of curtain sets, including a front curtain set, a side curtain set (FIGS. 3,4) and a backdrop curtain 63 (FIG. 4). These curtains are used for opening and closing the viewing area, for background scenery and for concealing the puppeteer from the audience. As shown in FIG. 3, the front curtain set comprises two split curtains 61 removably secured to a plurality of rings 64 slidable on curtain rod 56. The side curtain set comprises two side curtains 62 hung from the side walls 52 of the auxiliary stage and removably attached thereto by means of Velcro fasteners or the like. As shown in FIG. 4, the backdrop curtain 63 is hung from the rear wall 54 of the auxiliary stage and is removably attached thereto by means of Velcro fastening or the like.

The backdrop provides a scenery background and conceals the puppeteers from the audience. The backdrop curtain is made of relatively thin fabric, or a semi-transparent material. These materials enable the puppeteers to manipulate the puppets, stage, and accessories and to see the audience yet not be seen by the audience. The backdrop curtain may, alternatively, comprise one or a number of relatively small openings which provide the same advantages.

The illustrated embodiment further includes a lower curtain 65 (see FIG. 3) hung from the main stage and removably attached thereto by means of Velcro fasteners or the like, thereby concealing the puppeteer from the audience.

The illustrated embodiment further comprises a central supporting stand 70 (see FIG. 2) having telescoping parts 71 and 72 for adjusting the length of the stand and, correspondingly, the height of the theater for puppeteers of various heights and ages. Central stand 70 has a threaded upper end 71 secured to the main stage through the mounting opening 28 by a safety nut 73, thereby permitting 360° pivotal movement of the theater about stand 70. The lower end of the stand is removably received in a base 74. The base is, in turn supported by a tripod support 75.

Figure 4A:
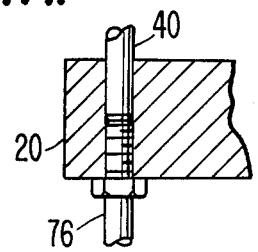
FIG. 4A is a cross-sectional view of the stage support and theater support means of FIG. 4 along the line A—A.

An alternative means for supporting the puppet theater is illustrated in FIG. 4 and 4A of the drawings. Four legs 76 are shown, received in a matching number of mounting openings 31 located at the four corners of the main stage 20.

Figure 5:
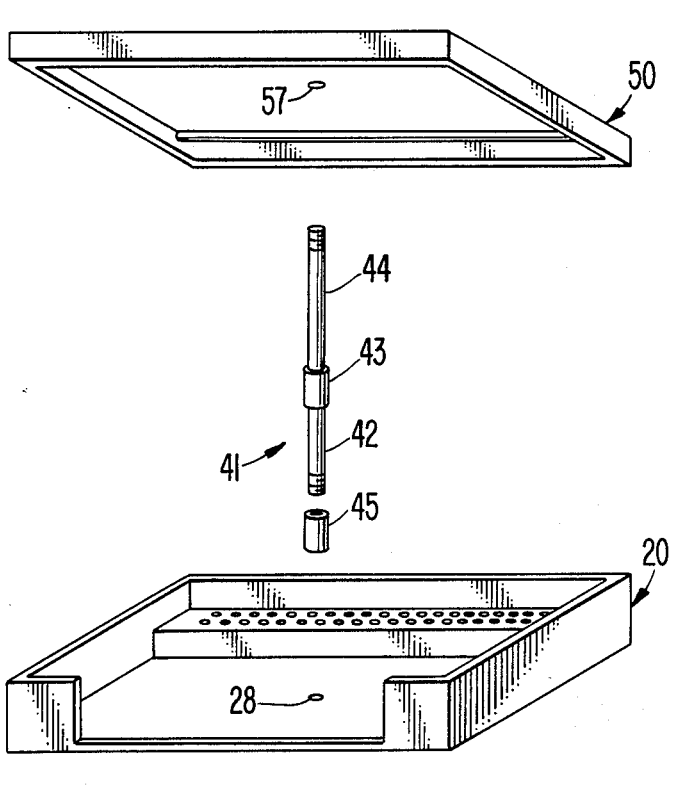
FIG. 5 is an exploded view of the structural elements of a further embodiment of the portable puppet theater, incorporating a single, central stage support.

In FIG. 5 an alternative structure 41 for securing main stage 20 to auxiliary stage 50 is shown. The structure includes a central support 41 having upper and lower threaded members 42 and 44 adjustably engaged in threaded joint 43. Upper member 44 is received in the auxiliary stage 50 through the mounting opening 57 located in the center of the auxiliary stage. Lower member 42 is received in a safety nut 45 which is secured to the main stage 20 through aperture 28 therein.

Figure 6:
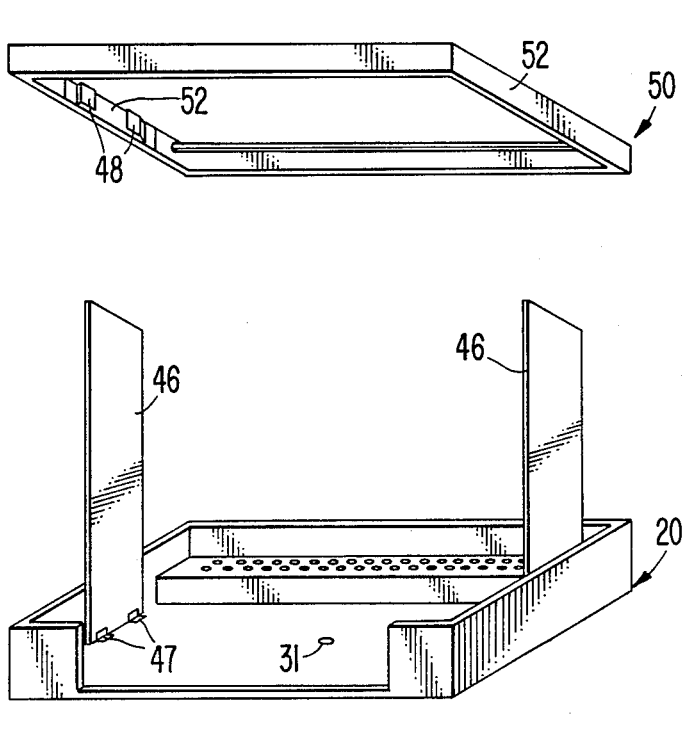
FIG. 6 is an exploded view of the structural elements of an additional embodiment of the theater, wherein the support means comprises hinged side wall elements.

A further alternate means for securing the main and auxiliary stages to one another is illustrated in FIG. 6. Folding stage supports 46 are depicted which are hinged to the base 21 of the main stage 20 by a number of hinges 47, each of which is received in a pair of slots 48 provided on the inner side of each side wall 52 of the auxiliary stage 50. In their assembled relation, the folding supports or side walls 46 provide firm structural support for the auxiliary and main stages. When the theater is disassembled the side walls 46 fold into the base of the main stage.

Other alternative means for securing the main and auxiliary stages in spaced relation include plural sets of support rods 40 having varying lengths, or collapsible support rods having telescoping elements. These elements provide for ready adjustment of the height of the viewing area of the puppet theater.

As described hereinabove, the structural components, props, curtains, puppets and accessories are normally stored within portable carrying case 10 (FIG. 1). When it is desired to assemble any of the embodiments of the puppet theater shown in FIGS. 2–6, the base 20 is detached from the lid 50 of the carrying case. All structural components and theater accessories are then removed from the carrying case. The base of the carrying case (the main stage of the theater) is thereafter attached to the lid (the auxiliary stage) by the theater support means (40, 41 or 46) engaged in the mounting openings of both stages. The means 70 or 76 for supporting the theater on the ground or on the floor may then be attached to the main stage through the mounting openings located on the main stage. The various curtain sets 60, together with any props (on scenery base 29) are then mounted to the stages 50 and 20, respectively, and the theater is ready for use. When it is desired to disassemble the theater, the respective components are disassembled as aforesaid, placed in the carrying case 10, and the kit is ready for transport or storage until the theater is again utilized.

It is to be understood that the above described embodiments of the invention are merely illustrative of the principles thereof and that modifications and embodiments of the invention may be derived within the spirit and scope thereof.

What I claim is:

1. A portable puppet theater kit, comprising:

(a) a carrying case comprising a base and a lid, said base being separable from said lid and convertible into a floor of a puppet theater, said floor functioning as a main stage for the puppet theater;

(b) said lid being convertible into a ceiling of the puppet theater, said lid having an outer face providing an outer housing for the puppet theater kit and an inner face;

(c) means removably received in the carrying case and being convertible into support means for supporting the ceiling in fixed, spaced relation relative to the floor, said support means being securable to the inner face of said lid and to the floor; and (d) a front curtain set removably received in the carrying case and being convertible into a curtain supported by the ceiling and at least partially shielding the space between the floor and ceiling from view during operation of the puppet theater.

2. The portable puppet theater kit of claim 1, wherein the floor comprises a base having rigid side, front and rear walls perpendicular thereto.

3. The portable puppet theater kit of claim 2, further comprising means removably received in the carrying case and being convertible into support means for the theater, wherein the means for supporting the theater comprises: (a) at least one mounting opening in the base of the floor, and (b) adjustable support means vertically securable to the floor through the mounting opening, said means for supporting the theater allowing for variation of the height of the puppet theater.

4. The portable puppet theater kit of claim 2, wherein the floor further comprises a rear access door.

5. The portable puppet theater kit of claim 1, wherein the ceiling comprises a base having rigid side, front and rear walls perpendicular thereto.

6. The portable puppet theater kit of claim 1, further comprising:

(a) a side curtain set removably received in the carrying case and being convertible into a curtain supported by said ceiling;

(b) a backdrop curtain removably received in the carrying case and being convertible into a curtain supported by said ceiling; and (c) means removably received in the carrying case and being convertible into support means for supporting said curtains from said ceiling.

7. The portable puppet theater kit of claim 1, wherein the support means comprises at least one mounting opening on the floor; a matching number of mounting openings on the ceiling; and at least one rod securable to said floor and ceiling through said mounting openings.

8. The portable puppet theater kit of claim 1, further comprising means removably received in the carrying case and being convertible into support means for the theater.

9. The portable puppet theater kit of claim 1, further comprising a scenery base removably received in the carrying case, for supporting decorations and scenery supported by said floor or ceiling.

10. The portable puppet theater kit of claim 1, wherein the carrying case comprises the base, the lid and means for locking the base to the lid.

11. The portable puppet theater kit of claim 1, wherein the carrying case further comprises handle means attached to the base or the lid for carrying the case.

12. The portable puppet theater kit of claim 1, wherein said ceiling functions as an auxiliary stage of the puppet theater.

13. A portable puppet theater kit, comprising:

(a) a carrying case comprising a base and a lid, said base being separable from said lid and convertible into a floor of the puppet theater;

(b) said lid being convertible into a ceiling of the puppet theater;

(c) means removably received in the carrying case and being convertible into support means for supporting the floor and ceiling, said support means comprising at least one rod securable to the floor and ceiling;

(d) a front curtain set removably received in the carrying case and being convertible into a curtain supported by said ceiling and at least partially shielding the space between said floor and ceiling from view during operation of the puppet theater;

(e) a side curtain set removably received in the carrying case and being convertible into a curtain supported by said ceiling;

(f) a backdrop curtain removably received in the carrying case;

(g) means removably received in the carrying case and being convertible into support means for supporting said curtains from said ceiling; and (h) means removably received in the carrying case and being convertible into support means for the theater comprising adjustable support means vertically securable to the floor.

14. A portable puppet theater kit, comprising:

(a) a carrying case comprising a base and a lid, said base being convertible into a ceiling of the puppet theater;

(b) said lid being convertible into a floor of the puppet theater, said lid having an outer face providing an outer housing for the puppet theater kit and an inner face, wherein said floor functions as a main stage for the puppet theater;

(c) means removably received in the carrying case and being convertible into support means for supporting the ceiling in fixed, spaced relation relative to the floor, said support means being securable to the inner face of said lid and to the floor; and (d) a front curtain set removably received in the carrying case and being convertible into a curtain supported by the ceiling and at least partially shielding the space between the floor and ceiling from view during operation of the puppet theater.

* * * * *